United States Patent [19]

Andersen

[11] Patent Number: 4,772,058

[45] Date of Patent: Sep. 20, 1988

[54] CARPET CLEAT

[76] Inventor: Carl H. Andersen, 230 C Walnut St., Suite 113, Chico, Calif. 95928

[21] Appl. No.: 100,174

[22] Filed: Sep. 23, 1987

[51] Int. Cl.[4] ..... A47G 27/04; E04F 21/20

[52] U.S. Cl. ..... 294/8.6; 254/200; 254/209

[58] Field of Search ..... 294/8.6; 16/5; 52/749; 248/1, 351, 357; 254/200-212

[56] References Cited

U.S. PATENT DOCUMENTS

| | | | |
|---|---|---|---|
| 574,122 | 12/1896 | Thompson | 254/205 |
| 651,924 | 6/1900 | Johnson | 254/204 |
| 3,216,702 | 11/1965 | Dahlke | 254/200 |
| 3,747,157 | 7/1973 | Szymanski | 254/200 X |
| 3,752,440 | 8/1973 | Ream | 254/209 |
| 4,008,879 | 2/1977 | Youngman | 254/201 |
| 4,730,858 | 3/1988 | Humann | 294/8.6 |

*Primary Examiner*—Johnny D. Cherry

[57] ABSTRACT

The invention provides substantial support for bracing the feet of rug stretchers during carpet laying. An open top box frame is centrally affixed to a substantially rectangular base. The edges of the base extend beyond the outer walls of the box frame sufficiently to form a stable platform. The platform is apertured with spaced nailing holes and when nailed firmly through the carpet being laid into the flooring, the attached box frame becomes a relocatable stable cleat for bracing the feet on the support arms of rug stretchers in a variety of positions.

5 Claims, 2 Drawing Sheets

CARPET CLEAT

BACKGROUND OF THE INVENTION

1. Field of the Invention

This invention relates to devices useful for stretching carpets. The present invention is particularly directed towards a cleat-type bracing device affixed firmly in a central position during carpet laying as a holding cleat to which the foot of a rug-stretching jack support member is biased.

2. Description of the Prior Art

Bracing devices similar to the structure of my invention are not prevalent in past art patents examined. The most pertinent patents appeared in the classes and subclasses: 294/8.6, 254/200, 212, 213, 210, and 209.

Patents which I considered most pertinent to my device included the following:

U.S. Pat. No. 328,653, dated Oct. 20, 1885, issued to Coble shows a carpet stretcher using a hook and pull device.

A patent issued to McCornack, U.S. Pat. No. 409,647, dated Aug. 20, 1889, illustrates a carpet stretcher using a hook and a cleated pad.

The McBeth device shown in U.S. Pat. No. 965,118, issued July 19, 1910, is a spiked platform with a cord and handle as the levering method.

U.S. Pat. No. 3,706,440, dated Dec. 19, 1972, issued to Ross illustrates a carpet stretcher with an adjustable arm and base for levering against a wall.

U.S. Pat. No. 3,747,157 issued to Szymanski on July 24, 1973, illustrates a triangular plate fitted with two adjustable levering arms useful for supporting the rug stretcher against two walls.

The carpet stretcher shown in the Youngman patent of Feb. 22, 1977, U.S. Pat. No. 4,008,879, is in the form of a pneumatic activated framework.

U.S. Pat. No. 4,509,725, dated Apr. 9, 1985, to Talavera shows a framed platform centrally fitted with a moveable center piece having holding spikes and a levering handle for repairing carpets.

My invention in structure or method was not demonstrated in the foregoing past-art patents which to my knowledged are most pertinent to my invention.

SUMMARY OF THE INVENTION

In practicing my invention I have provided an open top box frame centrally affixed to a rectangular base with the base extending beyond the edges of the box frame sufficiently to form a stable platform. The platform is apertured with spaced nailing holes and when nailed firmly through the carpet into the flooring, either wood flooring or concrete slab, the rectangular box frame becomes a stable cleat for bracing the foot members of support arms of rug stretchers thereagainst in a variety of positions.

Therefore, a primary object of my invention is to provide a positionable cleat useful as a brace to support the foot member on the extension arm of a rug stretcher device.

Another object of my invention is to provide a self-maintained bracing cleat that eliminates the need to brace the rug-stretcher arm against walls of a building.

A further object of the invention is to provide self-maintaining protable cleats structured for use individually or in mulitple applications where cross bracing and doubling cleating is more efficient.

Other objects and the many advantages of my invention will become clear with advantages of my numbered parts described in the specification and comparing them with similarly numbered parts shown on the accompanying drawings.

DRAWING REFERENCE NUMERALS

Figure 1:
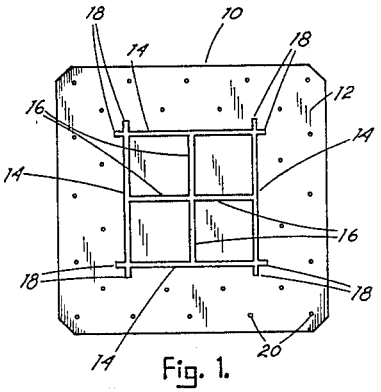
FIG. 1 shows the carpet cleat constituting this invention in a top plan view.

10: carpet cleat structure
12: rectangular base
14: outer box wall
16: inner box wall
18: extended corner wall stretcher foot guides
20: nailing apertures
22: carpet stretcher
24: carpet stretcher foot
26: wood bracing
28: pass-through opening for wood bracing
30: carpet

DESCRIPTION OF THE PREFERRED EMBODIMENT

Figure 2:
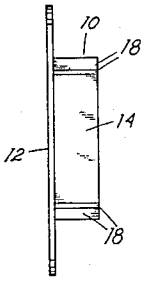
FIG. 2 shows the invention in a side view illustrating the base extended beyond the box frame.
Figure 3:
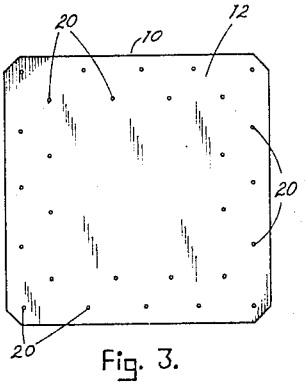
FIG. 3 shows the invention reversed from the illustration in FIG. 1 in a view of the bottom side of the apertured base.
Figure 4:
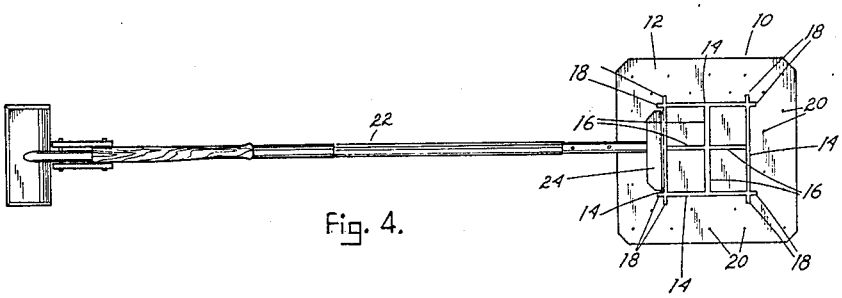
FIG. 4 shows the invention in a reduced top plan view being used as a cleat to brace the foot on the arm of a rug stretcher between protruding wall guides.
Figure 5:
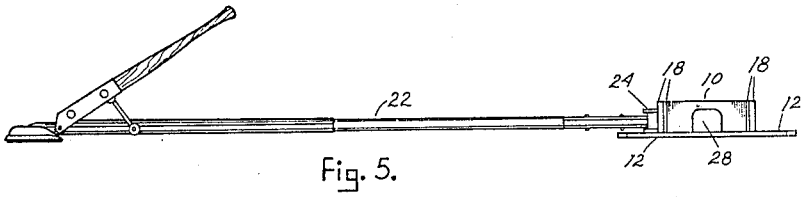
FIG. 5 shows the devices of FIG. 4 in a side view illustrating use and an embodiment of the invention having apertured walls for pass-through wood bracing.

Referring now to the drawings at FIG. 1, FIG. 2, and FIG. 3 where the invention is illustrated in front, side, and bottom views respectively. The entire carpet cleat structure 10 is shown in FIG. 1 in a top plan view with rectangular base 12 supporting outer box walls 14 which are in turn braced by inner box walls 16. Rectangular base 12 extends beyond box walls 14 to form a stable base for the wall structure. Extended corner wall stretcher foot guides 18 are extensions of outer box walls 14 and are useful as guides for carpet stretcher foot 24 as illustrated in FIG. 4 and FIG. 5. Nail apertures 20 are spaced in rectangular base 12 in the platform section extended outward past outer box walls 14.

In FIG. 4 and FIG. 5 of the drawings, the carpet cleat structure 10 is shown as a single unit in use. Rectangular base 12 can be positioned in a room without wall reference requirements. Rectangular base 12 is nailed to the floor with adequate wood or concrete nails inserted through nail apertures 20. The carpet cleat structure 10 is then useful as a brace for carpet stretcher 22. The carpet stretcher foot 24 is placed against outer box wall 14 and retained in position by extended corner wall stretcher foot guides 18. The outer box wall 14 supported by the crossed bracing of inner box wall 16 acts as a strong bracing cleat for carpet stretcher 22.

Figure 6:
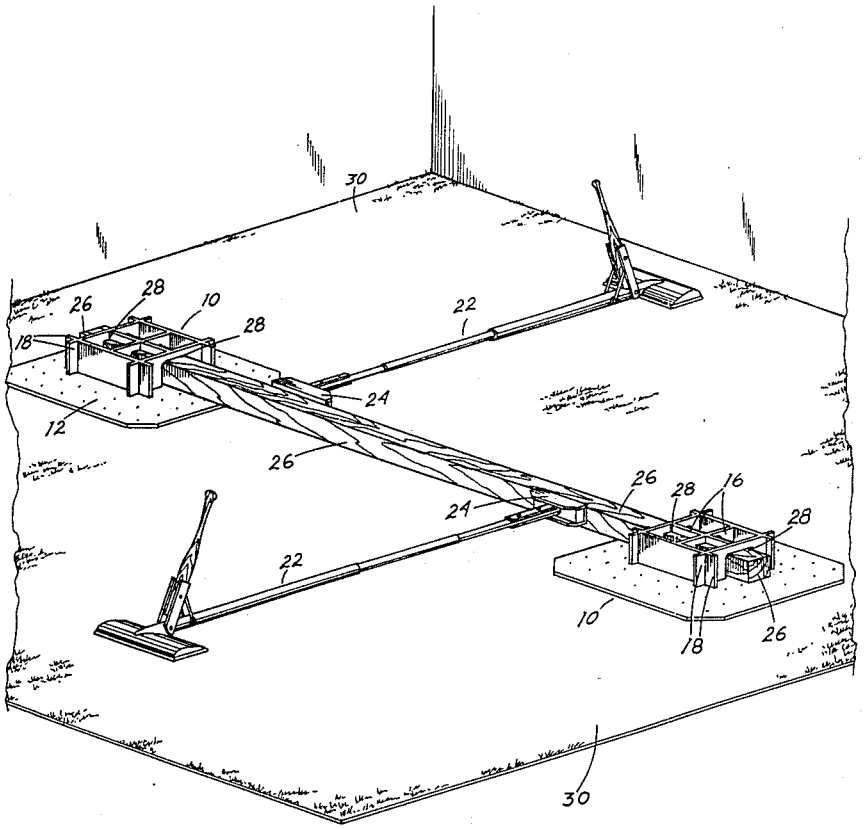
FIG. 6 illustrates two of the pass-through embodiments of the invention fastened to a floor and supporting a bracing member affixed between them as a centrally positioned bracing means for two opposing rug stretchers.

In FIG. 5, an embodiment of carpet cleat structure 10 is illustrated with pass-through opening 28 for wood bracing 26 cut through two paralleling sides of outer box wall 14 and centrally through inner box walls 16. This allows passage and retention of wood bracing 26 so that wood bracing 26 can be used as a cleating device anywhere along its length by several carpet stretchers 22 as illustrated in FIG. 6 of the drawings.

Although I have described embodiments of my invention in considerable detail in the specification, it is to be understood that modifications in the structure and design of the invention may be practiced which do not depart from the intended scope of the appended claims.

What I claim as my invention is:

1. A moveable carpet cleat for the positional bracing of the foot of a carpet stretcher comprising:

an open top box frame;

a substantially rectangular flattened base;

said open top box frame affixed centrally on said substantially rectangular flattened base;

said open top box frame having four outer walls converging end to end, vertically oriented with said flattened base downwardly affixed; said vertically oriented outer walls being of sufficient height to accommodate a standard wooden 4×4 traversing said outer walls horizontally via a pass-through opening for wood bracing cut through two paralleling said outer walls and bridged by crossed inner box walls forming supporting structure for said open top box frame;

said outer paralleling walls and said crossed inner box walls being solidly structured for single unit applications and having said pass-through opening and said bridging structure for multi-unit applications;

said outer walls extended at connecting corners sufficiently to produce protruding guide ends sized to fit the bracing foot of a carpet stretcher;

said flattened retangular base extended outwardly beyond said outer walls to form a platform therearound; said platform having mitered corners and multiple spaced nail apertures therethrough.

2. The movable carpet cleat of claim 1 wherein the materials of manufacture are metal, aluminum, or other lightweight alloy plate in a thickness range substantially of one-eighth inch to one-half inch cut to use size, welded, and said platform apertured for nailing.

3. The movable carpet cleat of claim 1 wherein the materials of manufacture are aluminum or other casting metals with said carpet cleat produced by a mold and sand casting.

4. The movable carpet cleat of claim 1 wherein the materials of manufacture are plastic and said carpet cleat is produced by plastic injection molding.

5. The movable carpet cleat of claim 1 wherein said pass-through opening for wood bracing cut through said two paralleling said outer walls is a bridged opening sized to accept up to and including said standard wooden 4×4 in slide through passage thereof.

* * * * *